US010176907B2

(12) United States Patent
Yang et al.

(10) Patent No.: US 10,176,907 B2
(45) Date of Patent: Jan. 8, 2019

(54) CABLE

(71) Applicant: FOXCONN INTERCONNECT TECHNOLOGY LIMITED, Grand Cayman (KY)

(72) Inventors: A-Nan Yang, Kunshan (CN); Hong-Ping Wang, Kunshan (CN); Lu-Yu Chang, New Taipei (TW)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/436,847

(22) Filed: Feb. 19, 2017

(65) Prior Publication Data

US 2017/0243676 A1 Aug. 24, 2017

(30) Foreign Application Priority Data

Feb. 19, 2016 (CN) ..... 2016 2 0218941 U

(51) Int. Cl.

*H01B 9/00* (2006.01)
*H01B 9/02* (2006.01)
*H01B 7/08* (2006.01)

(52) U.S. Cl.

CPC ..... *H01B 9/003* (2013.01); *H01B 7/0823* (2013.01); *H01B 9/006* (2013.01); *H01B 9/024* (2013.01); *H01B 9/028* (2013.01); *H01B 7/0861* (2013.01)

(58) Field of Classification Search

CPC ..... H01B 7/0823; H01B 7/0861; H01B 9/00; H01B 9/02; H01B 9/003; H01B 9/006; H01B 9/024; H01B 9/028; H01B 11/00; H01B 11/1091; H01B 11/002; H01B 11/20

USPC ..... 174/103, 110 R, 113 R

See application file for complete search history.

(56) References Cited

U.S. PATENT DOCUMENTS

| | | | | |
|---|---|---|---|---|
| 3,594,491 | A * | 7/1971 | Zeidlhack | H01B 11/1808 174/102 R |
| 3,666,878 | A * | 5/1972 | Turner | H01B 17/26 174/152 R |
| 6,444,902 | B1 | 9/2002 | Tsao et al. | |
| 6,844,500 | B2 * | 1/2005 | Williams | H01B 7/0823 174/110 R |
| 2003/0132022 | A1 * | 7/2003 | Williams | H01B 7/0823 174/113 R |

(Continued)

FOREIGN PATENT DOCUMENTS

| | | |
|---|---|---|
| CN | 203026202 | 6/2013 |
| CN | 103354117 | 10/2013 |

(Continued)

*Primary Examiner* — Timothy Thompson
*Assistant Examiner* — Guillermo Egoavil
(74) *Attorney, Agent, or Firm* — Wei Te Chung; Ming Chieh Chang

(57) ABSTRACT

A cable (100) includes a power wire (1), a ground wire (3), data transmission wires (2) between the power wire and the ground wire, and an insulating outer layer (4) enclosing the outer side of the power wire, the ground wire, and the data transmission wires. The power wire includes a conductor (11), an insulating layer (12) outside the conductor, and a metal shielding layer (13) outside the insulating layer. The power wire and the data transmission wires are spaced from each other by plastic materials.

1 Claim, 3 Drawing Sheets

(56) References Cited

U.S. PATENT DOCUMENTS

| | | | | |
|---|---|---|---|---|
| 2008/0226240 | A1* | 9/2008 | Mumm | H01B 11/04 385/101 |
| 2009/0114415 | A1* | 5/2009 | Morijiri | H01B 11/203 174/103 |
| 2010/0126754 | A1* | 5/2010 | Koga | H01R 12/594 174/105 R |
| 2010/0149794 | A1 | 6/2010 | Xu | |
| 2012/0184120 | A1* | 7/2012 | Basta | A61B 5/746 439/213 |
| 2014/0000924 | A1* | 1/2014 | Horan | H01B 11/1091 174/32 |
| 2016/0020002 | A1* | 1/2016 | Feng | H01B 11/20 174/103 |
| 2017/0069991 | A1* | 3/2017 | Hombo | H01R 12/79 |

FOREIGN PATENT DOCUMENTS

| | | | |
|---|---|---|---|
| CN | 103514986 | 1/2014 | |
| CN | 204303404 | 4/2015 | |
| CN | 204303404 U * | 4/2015 | H01B 11/00 |
| TW | M389916 | 10/2010 | |

* cited by examiner

CABLE

BACKGROUND OF THE INVENTION

1. Field of the Invention

The present disclosure relates to wire arrangement of a flat cable.

2. Description of Related Arts

Taiwan Patent No. 389916, issued on Oct. 1, 2010, discloses a cable of a flat type structure. The cable includes an outside layer enclosing data transmission wires and power transmission wires. The data transmission wires and the power transmission wires are arranged intimately close to each other.

China Patent No. 204303404, issued on Apr. 29, 2015, discloses a flat wire cable. The flat wire cable includes multiple conductive core wires conforming to Universal Serial Bus (USB) 2.0 specification. Insulation dielectric layers enclose corresponding core wires and wrapping layers enclose corresponding insulation dielectric layers. The flat wire cable further comprises an inner jacket and an outer jacket which sequentially wrap all the core wires.

An improved cable is desired.

SUMMARY OF THE INVENTION

Accordingly, an object of the present invention is to provide a flat cable with stable structure and good bending capability.

To achieve the above object, a cable includes a power wire, a ground wire, data transmission wires between the power wire and the ground wire, and an insulating outer layer enclosing the power wire, the ground wire, and the data transmission wires. The power wire includes a conductor, an insulating layer outside conductor, and a metal shielding layer outside the insulating layer. The power wire and the data transmission wire are spaced from each other by plastic materials.

Other objects, advantages and novel features of the invention will become more apparent from the following detailed description when taken in conjunction with the accompanying drawings.

DETAILED DESCRIPTION OF THE PREFERRED EMBODIMENT

Reference will now be made in detail to the preferred embodiment of the present invention.

Figure 1:
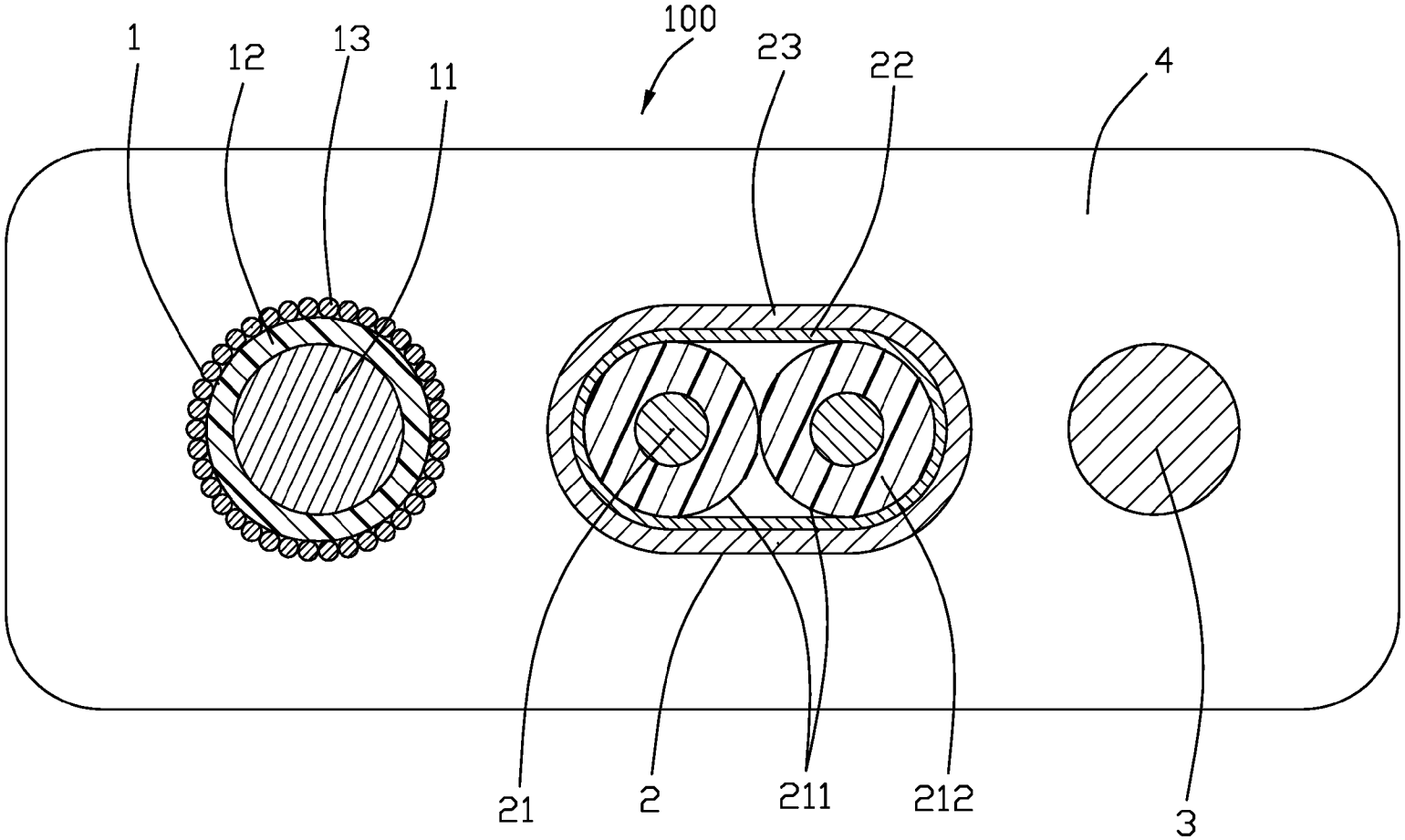
FIG. 1 is a cross-sectional view of a cable according to a first embodiment of the present invention.
Figure 2:
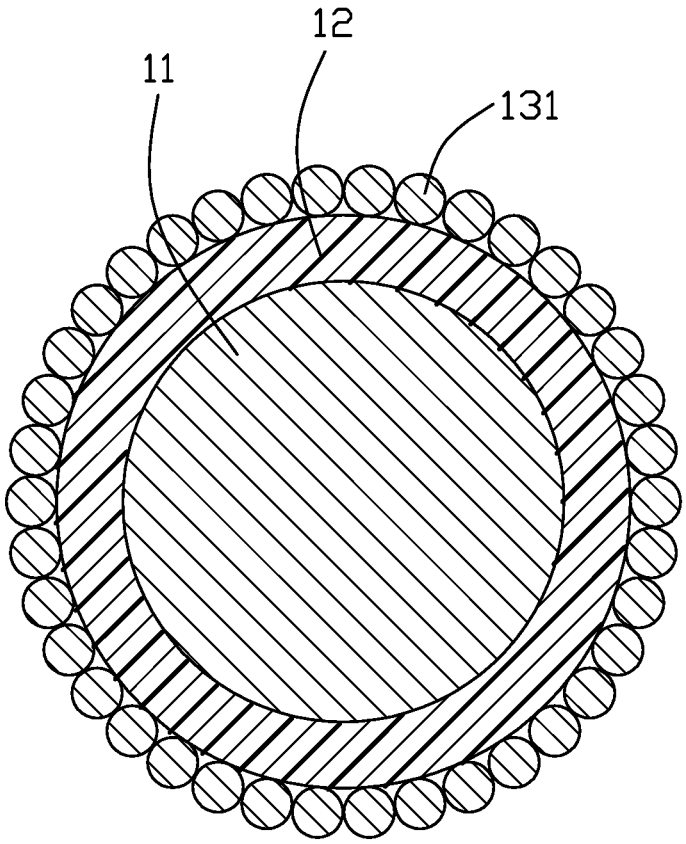
FIG. 2 is an enlarged view of a power wire of the cable in FIG. 1.

Referring to FIGS. 1 and 2, a cable 100 according to a first embodiment of the present invention is shown. The cable 100 includes a power wire 1, a ground wire 3, data transmission wires 2 between the power wire 1 and the ground wire 3, and an insulating outer layer 4 enclosing the power wire 1, the ground wire 3, and the data transmission wires 2.

The cable 100 is flat and complies with USB 2.0 cable specification.

The power wire 1 includes a conductor 11, an insulating layer 12 coated outside conductor 11, and a metal shielding layer 13 coated outside the insulating layer 12. The power wire 1 and the data transmission wires 2 are filled with plastic materials to improve the bending performance of the cable 100. The metal shield layer 13 of the power wire 1 is a wound metal shield layer 131. The metal shielding layer 13 is used as a ground return with the ground wire 3 and the metal braid layer 23 of the data transmission wires 2, which is beneficial for reducing ground resistance, reducing voltage drop, and realizing fast charging.

The data transmission wires 2 include a pair of differential signal wires 21, an inner shield layer 22 coated on the outer side of the pair of differential signal wires 21, and a metal braid layer 23 coated on the outer side of the inner shield 22. The inner shield layer 22 is an aluminum foil layer. The inner shield 22 is made of aluminum foil or PET (Polyethylene terephthalate) material. Each of the differential signal wires 21 includes a signal conductor 211 and an insulating layer 212 covered on the outside of the signal conductor 211.

The ground wire 3 is a bare conductor. The power wire 1 and the data transmission wires 2 are filled with plastic materials. Notably, according to the FIG. 1 a cross-section of the flat cable 100 defines a transverse direction along which the power wire 1, the data transmission wires 2 and the ground wire 3 are arranged, and a vertical direction perpendicular to the transverse direction. In the vertical direction, the dimension of the power wire 1 is similar to the dimension of the data transmission wires 2 while larger than the dimension of the ground wire 3.

Figure 3:
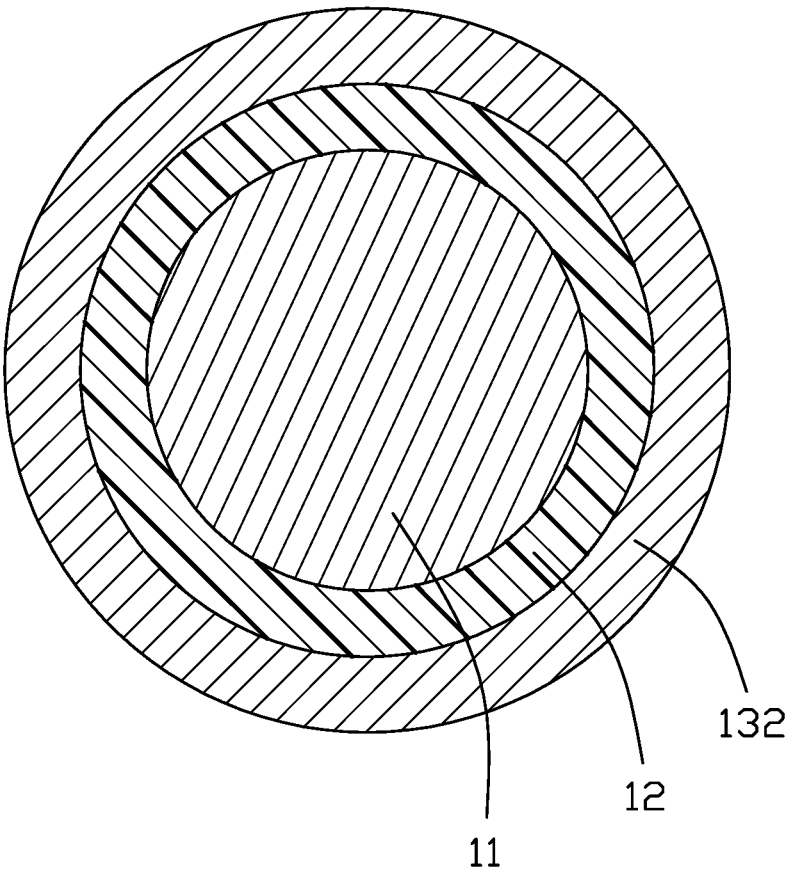
FIG. 3 is an enlarged view of a power wire according to a second embodiment.

Referring to FIG. 3, a power wire 1 of the cable 100 according to a second embodiment is shown. The metal shield layer 13 of the power wire 1 is a woven metal shield layer 132.

While a preferred embodiment in accordance with the present invention has been shown and described, equivalent modifications and changes known to persons skilled in the art according to the spirit of the present invention are considered within the scope of the present invention as described in the appended claims.

What is claimed is:

1. A cable comprising:

a power wire used for transmitting power;

a ground wire;

data transmission wires located between the power wire and the ground wire in a transverse direction; and an insulating outer layer enclosing the power wire, the ground wire, and the data transmission wires; wherein the power wire includes a conductor, a surrounding metal shielding layer, and an insulating layer intimately coated therebetween radially; and the data transmission wires, the power wire and the ground wire are essentially aligned with each other along said transverse direction, and are spaced from one another with corresponding gaps therebetween in said transverse direction; wherein the cable is flat with a cross-section defined by said transverse direction and a vertical direction perpendicular to said transverse direction; wherein the ground wire is bare conductor directly intimately enclosed within the insulating outer layer; wherein the data transmission wires include a pair of differential signal wires, an inner shield layer coated on the outer side of the pair of differential signal wires and a metal braid layer coated on the outer side of the inner shield layer; wherein in the vertical direction, a dimension of said power wire is similar to that of the data transmission wires while being larger than that of the ground wire.

* * * * *